US007836896B2

(12) United States Patent
Nadimi et al.

(10) Patent No.: US 7,836,896 B2
(45) Date of Patent: Nov. 23, 2010

(54) TOBACCO-LESS SMOKING MATERIAL

(75) Inventors: Abrahim Nadimi, Arlington, TX (US); Ali Seyed Nadimi, Arlington, TX (US); Sayyid Abdolmajid Nadimi, Arlington, TX (US)

(73) Assignee: Social Smoke, Inc., Arlington, TX (US)

( * ) Notice: Subject to any disclaimer, the term of this patent is extended or adjusted under 35 U.S.C. 154(b) by 729 days.

(21) Appl. No.: 11/769,948

(22) Filed: Jun. 28, 2007

(65) Prior Publication Data

US 2008/0000488 A1 Jan. 3, 2008

Related U.S. Application Data

(60) Provisional application No. 60/806,208, filed on Jun. 29, 2006.

(51) Int. Cl.
*A24B 15/00* (2006.01)

(52) U.S. Cl. ..... 131/352; 131/353; 131/354; 131/355; 131/356; 131/357; 131/359; 131/275; 131/276; 131/194; 131/336

(58) Field of Classification Search ..... None
See application file for complete search history.

(56) References Cited

U.S. PATENT DOCUMENTS 4,079,742 A * 3/1978 Rainer et al. ..... 131/359
4,119,104 A * 10/1978 Roth ..... 131/359

* cited by examiner

*Primary Examiner*—Philip C Tucker
*Assistant Examiner*—Phu H Nguyen
(74) *Attorney, Agent, or Firm*—Chernow Katz LLC

(57) ABSTRACT

A nontoxic, tobacco-less and flavored material for smoking, and a method of making the same. In one aspect, the invention is a tobacco-less material for smoking comprising: a shredded cellulosic paper having a weight; and a mixture of a humectant and a flavoring agent, the mixture having a weight and absorbed into the shredded cellulosic paper.

10 Claims, 1 Drawing Sheet

TOBACCO-LESS SMOKING MATERIAL

CROSS-REFERENCE TO RELATED APPLICATIONS

The present application claims the benefit of U.S. Provisional Patent Application 60/806,208, filed Jun. 29, 2006, the entirety of which is hereby incorporated by reference.

FIELD OF THE INVENTION

The present invention relates generally to the field of materials for smoking, and specifically to tobacco-less, non-toxic, flavored materials for smoking and methods of making the same.

BACKGROUND OF THE INVENTION

Traditionally, tobacco has been the base material for almost all smoking materials, including cigars, cigarettes, pipes, hookahs, etc. Over the past decade, smoking hookahs has become increasingly popular in both the United States and abroad. Unlike people who smoke by traditional means, such as cigarettes, a large amount of people who smoke hookahs do so solely as a social event and/or for the enjoyment of the flavor, rather than as a result of nicotine addiction. However, the existing materials for hookah smoking are still made from natural tobacco. This tobacco is commonly referred to hookah tobacco.

Hookah tobacco is processed by various methods to enhance or weaken different properties of the base tobacco. Once the base tobacco is processed, it can be flavored if desired. Such processes are well known in the art. Flavored hookah tobaccos are the most common materials smoked in hookahs.

Thus, despite the fact that hookahs are commonly smoked for enjoyment of flavor and as a social luxury, hookah smokers are still subjected to nicotine and other unhealthy additives and/or components that are inherent with all tobacco based products.

Thus, a need exists for a hookah smoking material that minimizes and/or is free of the unhealthy effects of existing hookah tobacco products while still delivering adequate flavor and the social enjoyment related with smoking.

SUMMARY OF THE INVENTION

It is therefore an object of the present invention to provide a smoking material that is a tobacco-less substance, and a method of making the same.

Another object of the present invention is to provide a hookah smoking material that is a tobacco-less substance, and a method of making the same.

Still another object of the present invention is to provide a flavored hookah smoking material that is a tobacco-less substance and substantially free of nicotine and other unhealthy substances found in tobacco, and a method of making the same.

Yet another object of the present invention is to provide a flavored smoking material that is a tobacco-less substance and easy and/or cost effective to manufacture.

These and other objects are met by the present invention which, in one aspect, is a flavored substantially non-toxic tobacco-less material for smoking. While this tobacco-less material can be smoked in pipes, cigarettes, cigars, etc., it especially lends itself for smoking in hookahs for the reasons discussed above. This inventive smoking material can completely replace tobacco.

In one embodiment, the invention can be a tobacco-less material for smoking comprising: shredded cellulosic paper; and a mixture of a humectant and a flavoring agent, the mixture absorbed into the shredded cellulosic paper.

In another embodiment, the invention can be a method of making a tobacco-less material for smoking comprising: a) shredding cellulosic paper; b) providing a mixture of a humectant and a flavoring agent; and c) combining the mixture of the humectant and the flavoring agent with the shredded cellulosic paper.

In yet another embodiment, the invention can be a method of making a tobacco-less material for smoking comprising: a) shredding cellulosic paper; b) weighing the shredded cellulosic paper; c) providing a mixture of a humectant and a flavoring agent, the mixture having a weight that is 7 to 12 times greater than the weight of the shredded cellulosic paper; and d) mixing the mixture of the humectant and the flavoring agent with the shredded cellulosic paper until the shredded cellulosic paper has a substantially uniform color and texture.

DETAILED DESCRIPTION OF THE DRAWINGS

Figure 1:
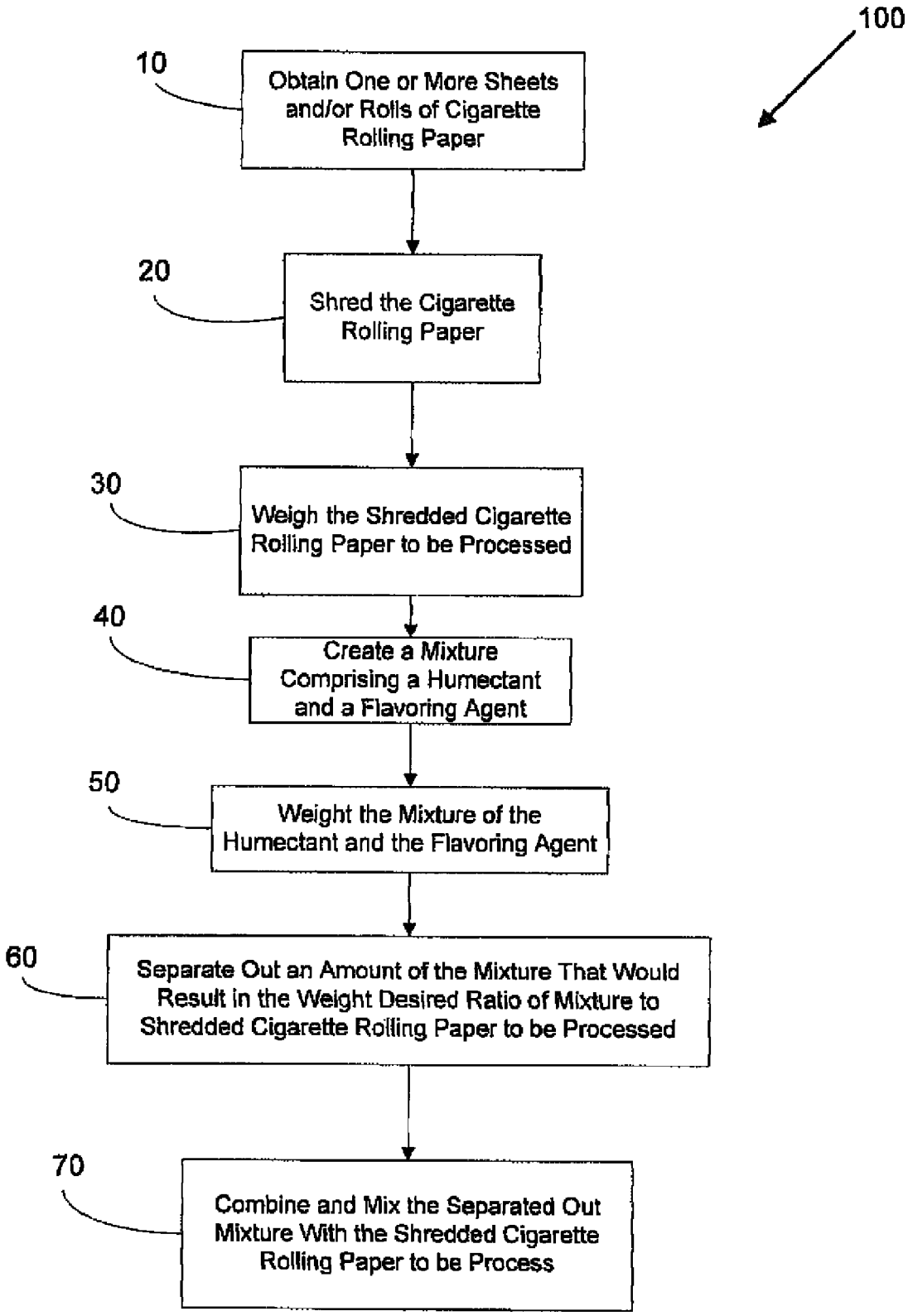
FIG. 1 is a flowchart for a method of making a tobacco-less material for smoking according to one embodiment of the present invention.

While an embodiment of the inventive method will be described in reference to FIG. 1, it is to be understood that, in another aspect, the invention is the resulting tobacco-less product and variations thereof.

Referring now to FIG. 1, a method of making a tobacco-less material for smoking in a hookah 100 is illustrated in a flowchart format. At initial step 10, a thin non-toxic material is selected as the starting material, such as rolls or sheets of cigarette rolling paper. Traditional cigarette rolling paper is preferred because it is readily available and safe for human consumption. However, if desired, other tobacco-less cellulosic materials can be used so long as these materials can withstand constant moisture without disintegrating.

The cigarette rolling paper (or other cellulosic material) selected at step 10 can be made of any base material, including without limitation wood pulp, esparto, hemp, flax, rice combinations thereof, etc. The cigarette rolling paper (or other cellulosic material) may also initially comprise an agent for facilitating slow burning, such as, for example, calcium carbonate, glycerin, agar, propylene glycol, sorbitol, hyaluronic acid, urea, or lactic acid. Of course, the initial presence of such a slow burning agent in the cigarette rolling paper (or other cellulosic material) selected at step 10 is not necessary and cigarette papers free of such agents can be used.

It is further preferable that the cigarette rolling paper chosen in step 10 be non-flavored, non-colored and non-gummed. While dyed and flavored cigarette rolling paper (or other cellulosic material) can be used as the starting material, a non-flavored, non-gummed, and plain colored paper is the preferred material because it offers the most control over the end product.

With respect to size, it is preferred that the cigarette paper (or other cellulose material) be thin and not exceed 0.20 inches in thickness. More preferably, the thickness of the cigarette paper (or other material) does not exceed 0.15 inches in thickness. The width is preferred to be equal to or less than 1 inch. While the use of materials exceeding these dimensions is still within the scope of the present invention, using materials with such dimensions will produce an end product that is bulky and unattractive in that it will not resemble the traditional tobacco used in hookah smoking.

It is desired that the end smoking product of the present invention resemble traditional hookah tobacco in appearance. However, because traditional cigarette rolling paper typically comes in sheet or roll form, the cigarette rolling paper (or other cellulosic material) needs to be prepared (i.e., mechanically altered) to provide a more traditional tobacco like appearance. Therefore, once the desired cigarette rolling paper (or other cellulosic material) is obtained, the cigarette rolling paper (or other cellulosic material) is shredded, thereby completing step 20 of method 100. The preferred shredding method is achieved by utilizing a confetti cut paper shredder, thereby resulting in elongated shreds of the cigarette rolling paper (or other cellulosic material) typically having a width of about 0.25 inches to 0.50 inches and a length of about 0.75 inches to 1.25 inches. This shredding method yields a product that ultimately most resembles the look of traditional hookah tobacco. Other shredding styles can also be used.

While shredding is the preferred mechanical preparation process, the cigarette rolling paper (or other cellulosic material) can be prepared by a variety of cutting methods and apparatus, including manual preparation.

In addition to the aesthetic appeal of shredding the cigarette rolling paper (or other cellulosic material), the reduced size of the pieces of the cigarette rolling paper also helps the cigarette rolling paper (or other cellulosic material) mix well with the added ingredients, as will be described below.

Once the cigarette rolling paper (or other cellulosic material) is adequately shredded, the portion of the shredded cigarette rolling paper (or other cellulosic material) that will be processed is weighed using a conventional scale or other measuring apparatus, thereby completing step 30 of method 100. As will be described below, the weight of the shredded cigarette rolling paper (or other cellulosic material) to be processed is used to determine the weight of the mixture of humectant and flavoring agent to be used during the preparation process. Of course, the weight of the mixture can be conversely used to determine the portion of the shredded cigarette rolling paper (or other cellulosic material) to be used.

Once the portion of the shredded cigarette rolling paper (or other cellulosic material) that will be processed is weighed, a liquid mixture is created by mixing a humectant and a flavoring agent. This liquid mixture is created for combination with the shredded cigarette rolling paper (or other cellulosic material), as will be described in detail below. The humectant is used to: (1) keep the end smoking product moist; (2) provide resilience to the end smoking product during burning and the application of heat; (3) enhance flavor to the end smoking product; and (4) provide volume to the smoke created by the end smoking product. Suitable humectants include without limitation propylene glycol, vegetable-based glycerine, or other FDA approved types of humectants which are known to those skilled in the art.

The flavoring agent is used to flavor the end product. Suitable flavoring agents include without limitation natural herbs, natural and artificial flavoring processed from fruits, spices, and herbs. Sufficient flavoring agent is added to the humectant so that the flavor is carried when the end smoking product is smoked. The flavoring agent should be of an adequate concentration that the flavoring agent is added at no more than 10% of the weight of the humectant during creation of the mixture. Once the desired amount of the flavoring agent is added to the humectant, the resulting mixture (which can be thought of as a flavored humectant) can be stirred if desired, thereby completing creation step 40 of the method 100.

In an alternative embodiment of the invention, a coloring agent may also be added to the mixture of the humectant and the flavoring agent. A suitable coloring agent may be standard food coloring. As will become apparent from the discussion below, the addition of the coloring agent to the mixture allows for a visual indication during the mixing process of how well the ingredients are combining as well as for a more desirable color of the end product. The concentration of the food coloring is preferably sufficient to have negligible impact on the desired ratio of the mixture to the shredded paper.

Referring still to FIG. 1, once the mixture of the humectant and the flavoring agent (and optionally the coloring agent also) is created, the mixture is weighed, thereby completing step 50. An amount of the mixture that would yield a ratio between 7:1 to 12:1 by weight of the mixture to the shredded cigarette rolling paper (or other cellulosic material) to be processed is then separated out, thereby completing step 60 of method 100. More preferable, the ratio of the mixture to be added to the shredded paper is 10:1 by weight.

Once this is completed, the separated amount of the mixture is combined with the shredded cigarette rolling paper (or other cellulosic material) weighed in step 30. The combination can be done in a bowl or other apparatus that can hold liquids. Once the mixture and the shredded paper are combined in the bowl, the combined ingredients are mixed until the shredded cigarette rolling paper has a uniform consistency of color and texture, thereby completing step 70 of method 100. This typically takes 3-5 minutes.

The mixing step 70 is preferably completed at ambient temperature. However, in some embodiments, the mixture may be heated before and/or during the mixing process.

While the invention has been described and illustrated in sufficient detail that those skilled in this art can readily make and use it, various alternatives, modifications, and improvements should become readily apparent without departing from the spirit and scope of the invention.

What is claimed is:

1. A tobacco-less material for smoking comprising:

a shredded cellulosic paper having a weight;

a mixture of a humectant and a flavoring agent, the mixture having a weight and absorbed into the shredded cellulosic paper; and wherein the ratio of the weight of the mixture to the weight of the shredded cellulosic paper is in a range between 7:1 to 12:1.

2. The tobacco-less material of claim 1 wherein the ratio of the weight of the mixture to the weight of the shredded cellulosic paper is approximately 10:1.

3. The tobacco-less material of claim 1 wherein the weight of the flavoring agent in the mixture is less than or equal to 10% of the weight of the humectant.

4. The tobacco-less material of claim 1 wherein the mixture further comprises a coloring agent.

5. The tobacco-less material of claim 1 wherein the shredded cellulosic paper is a cigarette paper.

6. The tobacco-less material of claim 5 wherein the cigarette paper has a base material selected from a group consisting of a wood pulp, esparto, hemp, flax and rice.

7. The tobacco-less material of claim 5 wherein the cigarette paper comprises an agent for facilitating slow burning prior to absorbing the mixture.

8. The tobacco-less material of claim 7 wherein the slow burning agent is calcium carbonate, glycerin, agar, propylene glycol, sorbitol, hyaluronic acid, urea, or lactic acid.

9. The tobacco-less material of claim 1 wherein the shredded cellulosic paper is non-flavored prior to absorbing the mixture and is non-gummed.

10. The tobacco-less material of claim 1 wherein the shredded cellulosic paper has a thickness of less than or equal to 0.20 inches.

* * * * *